US011318772B2

(12) United States Patent
Jackson et al.

(10) Patent No.: US 11,318,772 B2
(45) Date of Patent: May 3, 2022

(54) PRINTING SYSTEM USING VIBRATION-DRIVEN PARTICLE APPLICATOR

(71) Applicant: Palo Alto Research Center Incorporated, Palo Alto, CA (US)

(72) Inventors: Warren B. Jackson, Dublin, CA (US); Kent Evans, Sunnyvale, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 189 days.

(21) Appl. No.: 16/791,541

(22) Filed: Feb. 14, 2020

(65) Prior Publication Data

US 2021/0252892 A1 Aug. 19, 2021

(51) Int. Cl.
*B41M 5/00* (2006.01)
*B41J 2/045* (2006.01)

(52) U.S. Cl.
CPC ..... *B41M 5/0017* (2013.01); *B41J 2/04501* (2013.01); *B41J 2/04533* (2013.01)

(58) Field of Classification Search
CPC ... C09D 11/107; C09D 11/322; C09D 11/101; C09D 11/326; C09D 11/38; C09D 11/36; C09D 11/40; C09D 11/30; C09D 11/32; C09D 11/324; C09D 11/328; C09D 11/102; C09D 11/005; C09D 11/54; C09D 11/52; C09D 11/106; C09D 11/03; C09D 11/037; C09D 11/033; B41J 11/0021; B41J 2/2107; B41J 2/01; B41J 11/002; B41J 2/211; B41J 2/1433; B41J 2/17; B41J 2/17593; B41J 2/1755; B41J 2/2114; B41J 2/2117; B41J 2/2056; B41J 2/21; B41J 2/0057; B41J 3/60; B41J 2002/012; B41J 2/04598; B41J 2/04588; B41J 2/04595; B41J 2/04586; B41J 2/14274; B41J 2/1623; B41J 2202/00; B41J 2202/03; B41J 2/14201; B41J 2/045; B41J 11/0015; B41J 2/04581; B41J 2/055; B41J 2/16538; B41J 2002/16502; B41J 29/02; B41J 2/17513; B41J 2/17509; B41J 29/13; B41J 2/17553; B41J 2/1606;

(Continued)

(56) References Cited

U.S. PATENT DOCUMENTS 10,384,463 B2 8/2019 Jackson et al.
2004/0101619 A1* 5/2004 Camorani ..... B05D 5/06 427/180

(Continued)

FOREIGN PATENT DOCUMENTS

JP 2001214113 8/2001

OTHER PUBLICATIONS

U.S. Appl. No. 16/210,656, filed Dec. 5, 2018.

*Primary Examiner* — Manish S Shah
(74) *Attorney, Agent, or Firm* — Mueting Raasch Group

(57) ABSTRACT

An apparatus includes a jet that applies a liquid binder to an application surface and a particle applicator. The particle applicator includes a particle reservoir with at least one movable surface, an electrically controlled actuator that causes vibrations of the movable surface, and a dispersal port though which particles can exit the particle reservoir. A controller is coupled to cause the vibrations via the actuator. The vibrations result in movement of the particles through the dispersal port towards the liquid binder on the application surface.

22 Claims, 9 Drawing Sheets

(58) Field of Classification Search
CPC ..... B41J 2/1642; B41J 2/1609; B41J 2/164; B41J 2/162; B41J 2/161; B41J 2/19; B41J 15/04; B41J 25/001; B41J 25/34; B41J 25/003; B41J 25/312; B41J 2025/008; B41J 2202/21; B41J 2/17596; B41J 2/16508; B41J 2/1652; B41J 2/175; B41J 2/17563; B41J 2/04501; B41J 2/04533; B41M 5/0023; B41M 7/0081; B41M 3/006; B41M 3/003; B41M 5/0011; B41M 5/0017; B41M 5/0047; B41M 7/00; B41M 7/0072; B41M 5/52; B41M 5/5218; B41M 5/5227; G02B 5/20; G02B 5/223; C08K 3/11; C08K 2003/2237

See application file for complete search history.

(56) References Cited

U.S. PATENT DOCUMENTS

| | | | | |
|---|---|---|---|---|
| 2007/0076069 | A1* | 4/2007 | Edwards | B41J 11/002 347/100 |
| 2012/0269983 | A1* | 10/2012 | Grinberg | B41M 3/006 427/470 |
| 2013/0043211 | A1* | 2/2013 | Vermeulen | B44C 1/20 216/28 |
| 2014/0199531 | A1* | 7/2014 | Pervan | C09D 11/103 428/207 |
| 2015/0030817 | A1* | 1/2015 | Wiegelmann | B44C 5/04 428/195.1 |
| 2015/0274997 | A1* | 10/2015 | Pervan | B05D 1/02 428/207 |
| 2018/0133956 | A1 | 5/2018 | Buller et al. | |
| 2019/0351682 | A1 | 11/2019 | Jackson et al. | |

* cited by examiner

PRINTING SYSTEM USING VIBRATION-DRIVEN PARTICLE APPLICATOR

SUMMARY

The present disclosure is directed to a printing system using vibration-driven particle applicator. In one embodiment, an apparatus includes a jet that applies a liquid binder to an application surface and a particle applicator. The particle applicator includes a particle reservoir with at least one movable surface, an electrically controlled actuator that causes vibrations of the movable surface, and a dispersal port though which particles can exit the particle reservoir. A controller is coupled to cause the vibrations via the actuator. The vibrations result in movement of the particles through the dispersal port towards the liquid binder on the application surface.

In another embodiment, a method involves depositing a liquid binder from a print head to an application surface. An actuator is electrically controlled to cause vibrations of a movable surface of a particle reservoir of the print head. The vibrations result in movement of particles through a dispersal port of the particle reservoir towards the liquid binder on the application surface. Relative motion is caused between the application surface and the print head. The relative motion results in the liquid binder and the particles forming a pattern on the application surface.

These and other features and aspects of various embodiments may be understood in view of the following detailed discussion and accompanying drawings.

BRIEF DESCRIPTION OF THE DRAWINGS

The discussion below makes reference to the following figures, wherein the same reference number may be used to identify the similar/same component in multiple figures.

and

Figure 10:
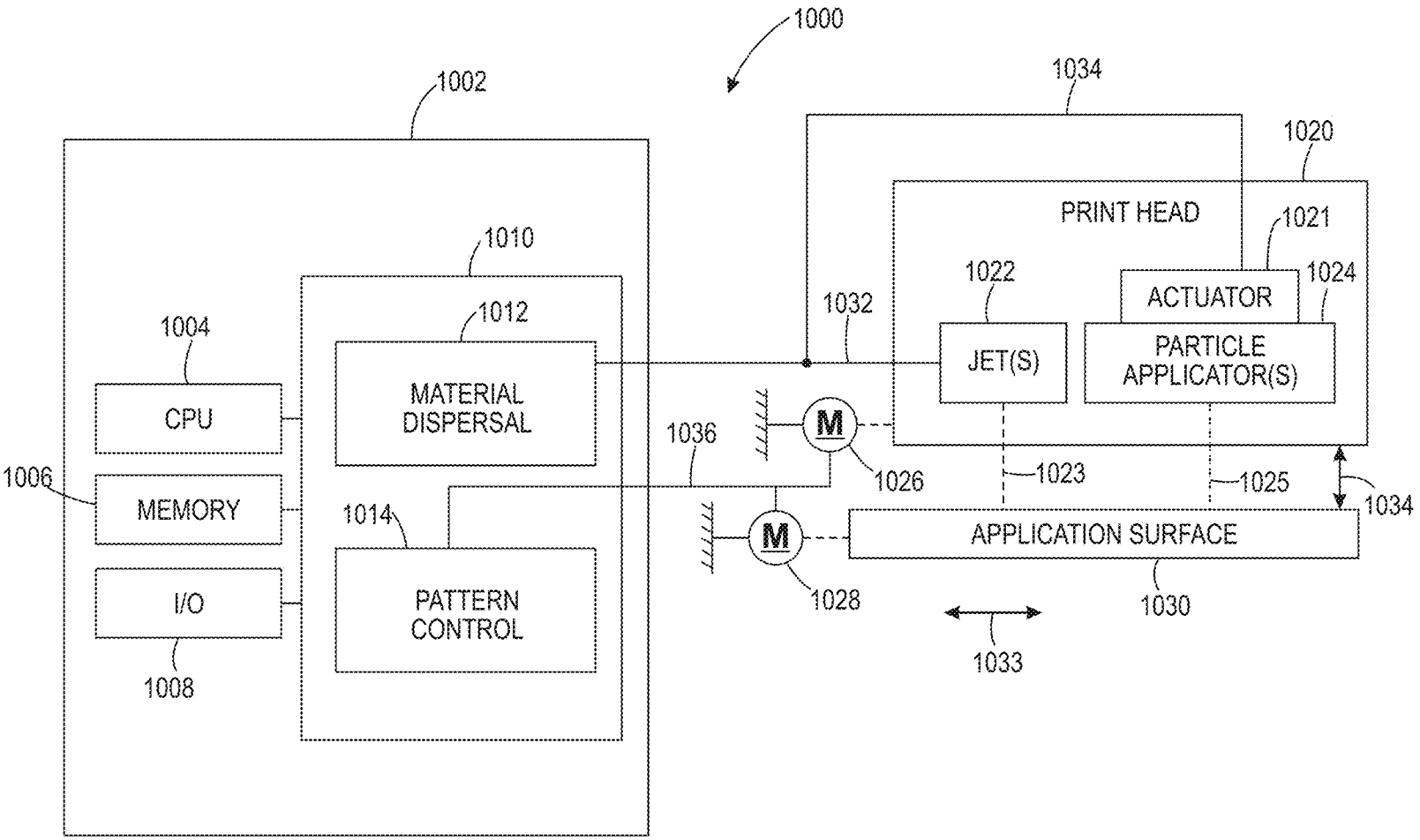

FIG. 10 is a block diagram of a system according to an example embodiment.

DETAILED DESCRIPTION

Powder jet is a technology which allows the printing of high particle-concentration-loaded, high-resolution patterns by combining an inkjet to deposit a high spatial-resolution binder pattern which is then loaded with particles using a particle jet. The particles may be configured to change at least one property of the liquid, such as the color, surface texture, opacity, luminescence, and/or other properties of the liquid. For example, saturated colors such as white may be more easily achieved by using a high proportion of solid materials to liquid.

Previous particle dispersal jets entrained particles into a continuous stream of air. While this technique is effective at producing high density particle streams, it has a few challenges. First, the technique utilizes a continuous stream of air and needs a way of introducing particles to this stream. Generating this air stream requires substantial external systems such as fans, auxiliary power supplies. Second, the air must be vented somewhere, which causes further cost and complexity. Third, the particle must be removed from the air stream which is difficult and prevents easy low-cost vented solutions. Fourth, the ability to start/stop the particle stream is reduced because starting/stopping the continuous airstream is slow and costly. The result is particles are dispersed in a larger area than necessary. In embodiments described herein, a powder jet printing system includes features that address these issues.

Figure 1:
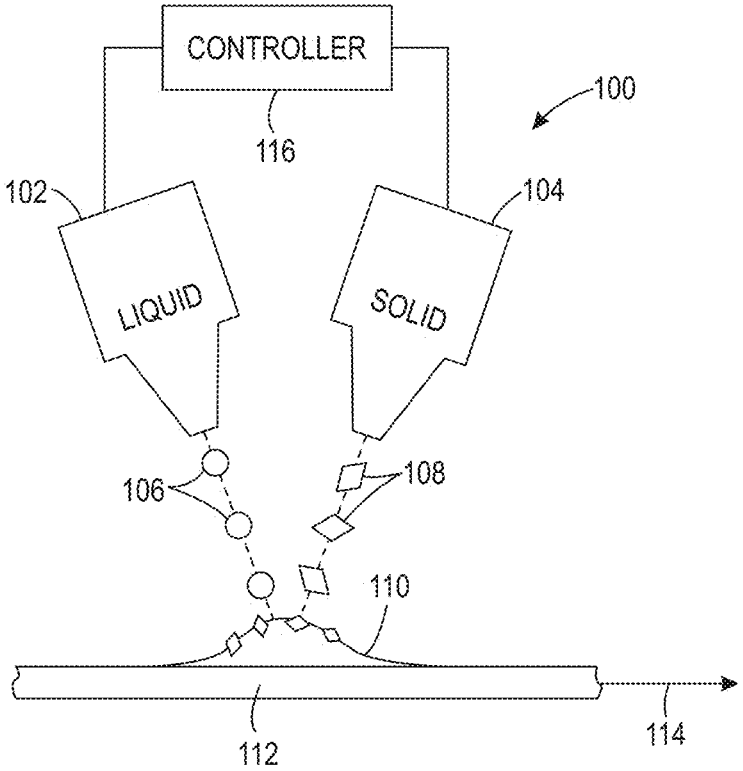
FIG. 1 is a diagram illustrating a printing system according to an example embodiment.

In FIG. 1, a simplified diagram shows a powder jet printing system 100 according to an example embodiment. The system 100 includes a liquid applicator 102 that dispenses drops 106 of a liquid printing substance such as ink, binder, etc. A solid applicator 104 dispenses particles 108 of a solid substance such as a solid ink, chemical compound that changes properties of the liquid, fibers (or any non-equidimensional shape such as flakes, loops, etc.) that enforce a three-dimensional (3-D) structure, etc. Together the applicators 102, 104 deposit a printed pattern 110 onto an application surface 112, which may be a print media for two-dimensional printing. For three-dimensional printing, the application surface 112 may be a printing base (for the first pass) and previously applied layers of the printed pattern. The printed pattern 110 includes a combination of the liquid materials 106 and solid materials 108. As indicated by arrow 114, relative motion between the application surface 112 and applicators 102, 104 is induced to create the desired printed artifacts on the application surface 112. These operations are coordinated by a controller 116, e.g., a special-purpose or general-purpose processor.

Note that the applicators 102, 104 are schematically illustrated as being directed the same point location 110 such that they would deposit the respective liquid materials 106 and solid materials 108 in approximately the same location 110 at the same time. In other embodiments, the applicators 102, 104 could be physically separated such that there is a delay between deposition onto a particular location 110. Also note that although one applicator of each type is shown, multiple such applicators may be used. For example, there may be two or more liquid and/or two or more particle applicators that each output a different color, thickness, viscosity, particle size, etc.

Figure 2:
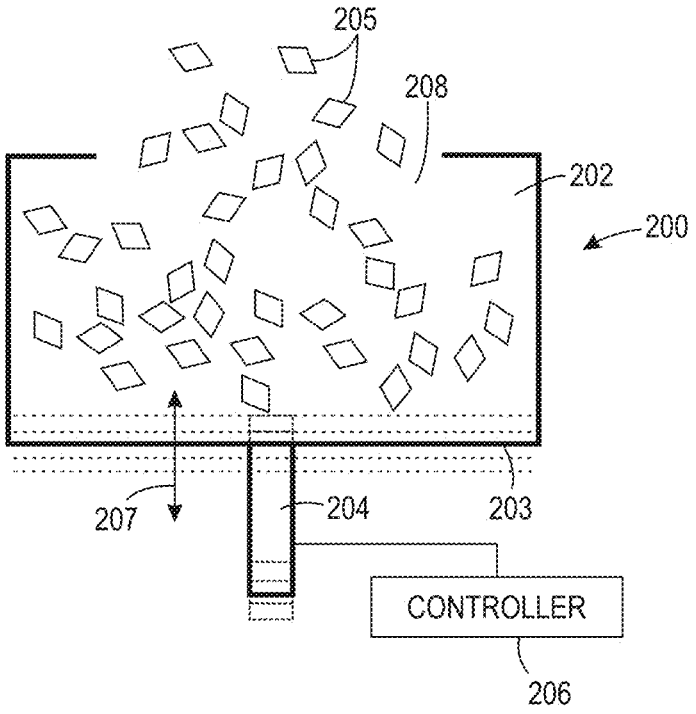
FIGS. 2-5 are diagrams of particle applicator reservoirs according to example embodiments.

This disclosure describes embodiments of the solid/particle applicator component of the powder jet system. In FIG. 2, a diagram shows a particle applicator 200 according to an example embodiment. The applicator 200 includes a particle reservoir 202 with at least one movable surface 203. An electrically-controlled actuator 204 causes vibrations of the movable surface 203, as indicated by the arrow 207. This actuator 204 may be, for example, a piezoelectric element (e.g., plate or speaker), a linear voice coil, rotating motor driving a cam, etc. It may also be possible to use non-electric actuators, e.g., micro-hydraulic or micro-pneumatic motor, although such actuators would ultimately be electrically controlled. A controller 206 inputs a current to the electrically driven actuator to cause the vibrations. The vibrations result in movement of particles 205 in the particle reservoir towards and through a dispersal port 208 of the particle reservoir 202.

Figure 3:
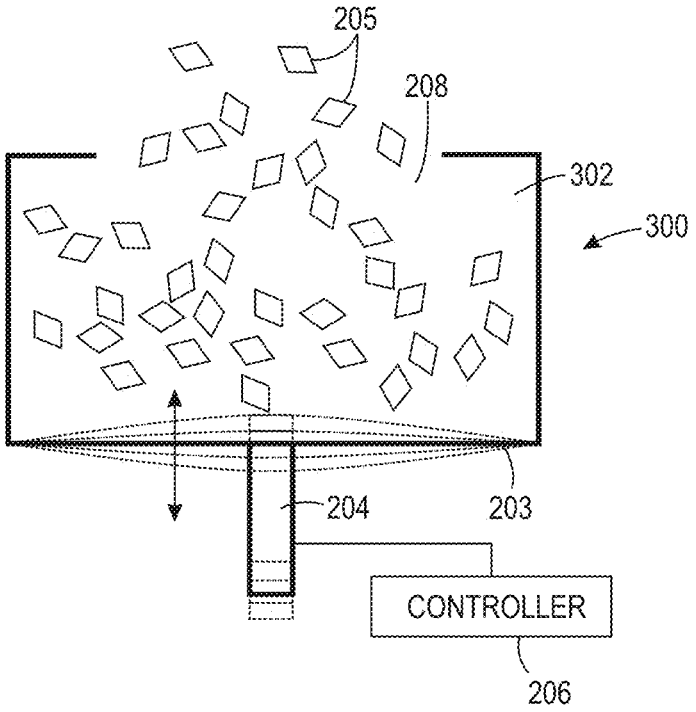

As indicated by the dotted lines in FIG. 2, the movable surface 205 primarily exhibits rigid body motion, such a piston inside of cylinder. As with any structure, the movable surface 205 will deform some small amount in response to the vibrational input, however in this case the small deformation would not have significant effect on the particles 205 relative to the larger rigid-body motions of the movable surface 205. In contract, FIG. 3 shows a particle applicator 300 with a particle reservoir 302 that uses a flexible movable surface 303. In this case, one part of the surface 303 (e.g., one or more edges) is fixed to the reservoir 302 or some other structure, and the surface 303 undergoes a vibrational mode in response to movement of the actuator 204, e.g., like a drumhead.

In both FIGS. 2 and 3, the movable surfaces 203, 303 are substantially planar when not being driven by the actuator (surface 203 will remain substantially planar even when driven). In other embodiments, the movable surface 203, 303 may have different resting shapes, e.g., convex or concave relative to the inside of the reservoirs 200, 300. A shaped movable surface may help guide the particles 205 to a desired spatial distribution proximate the port 208.

The movable surfaces 203, 303 may have physical characteristics (e.g., resonance frequency, damping factor) that enable significant displacement of the particles 205 at certain frequencies, e.g., a resonance frequency if the applicators 200, 300. In some embodiments, more than one vibration actuator (e.g., an array of actuators) may be used with a single or multiple movable surfaces which, by virtual of the relative phasing, results in spatial patterns of vibration which can be used to steer the particles by steering the air vibration via beam steering. Generally, the controller 206 may attempt to achieve these resonances and spatial patterns by applying control signals to the actuator(s) 204, e.g., a combination of pure tones at predetermined frequencies. The geometry particle applicators 200, 300 and the characteristics of the control signals may also be selected based on characteristics of the particles 205. For example, such as print system may be used with particles in a non-limiting range from 0.02 mm up to 100's of microns. For this wide a range of sizes, the size and shape of the particle applicators 200, 300 as well as controller drive signals can vary significantly.

Figure 4:
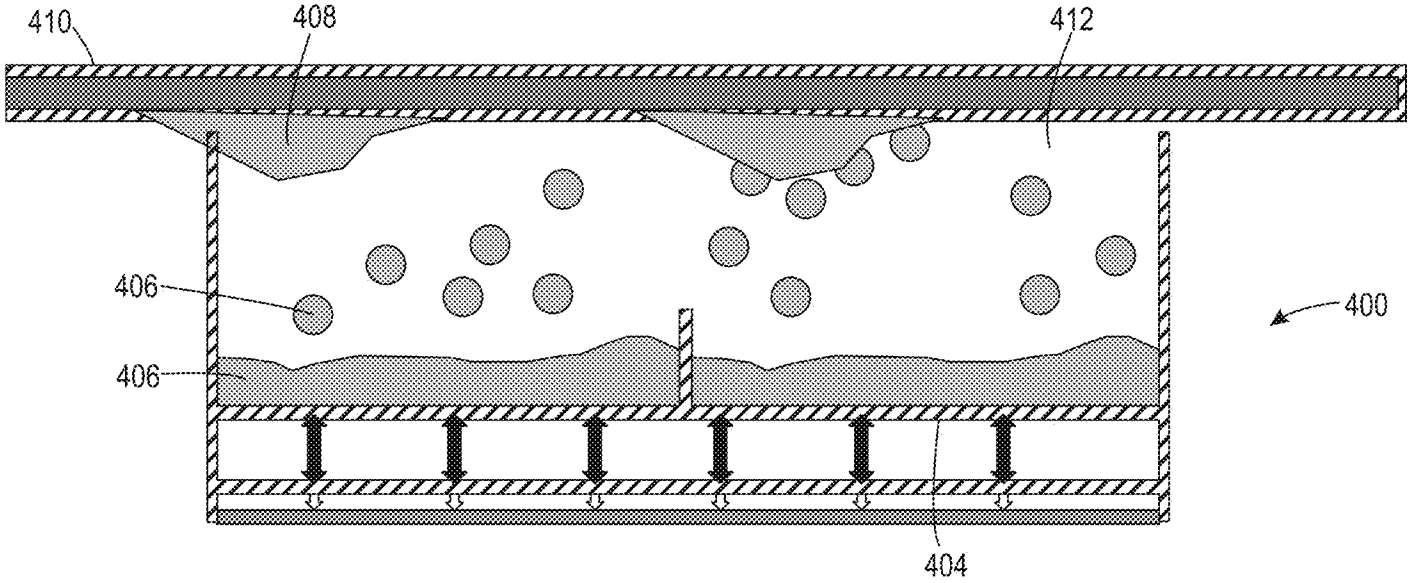

In FIG. 4, a cross-sectional view shows a particle applicator 400 according to an example embodiment. This example includes a particle/powder reservoir 402 with a moveable bottom surface 404 such as an electrically driven structure. The bottom surface 404 may be a voice coil motor (e.g., as in a loudspeaker), piezoelectric device, or some other driven plane which can move at kHz oscillatory frequencies or higher. The vibrations cause air to be entrained into the particle reservoir 402 and cause the particles 406 to levitate and be driven towards a surface of the application surface 410 where a nearby inkjet has deposited a high-resolution pattern of liquid 408, e.g., ink or binder.

The particle reservoir 402 includes a relatively large dispersal port 412, e.g., much larger than a minimum feature size of the deposited liquid 408. In this way, the particles 406 are relatively unfocused, hitting large areas of deposited liquid 408. At this stage, the liquid 408 has not dried or hardened, and therefore the particles 406 will stick to the liquid depositions 408 but not (significantly) to the regions of the application surface 410 that are not covered in liquid 408. The particle applicator 402 includes a relatively large dispersal port 412, e.g., much larger than a minimum feature size of the deposited liquid 408. In this way, the particles 406 are relatively unfocused, hitting large portions of deposited liquid 408 and the surrounding area. This enables rapid and uniform application of particles over a wide area.

Figure 5:
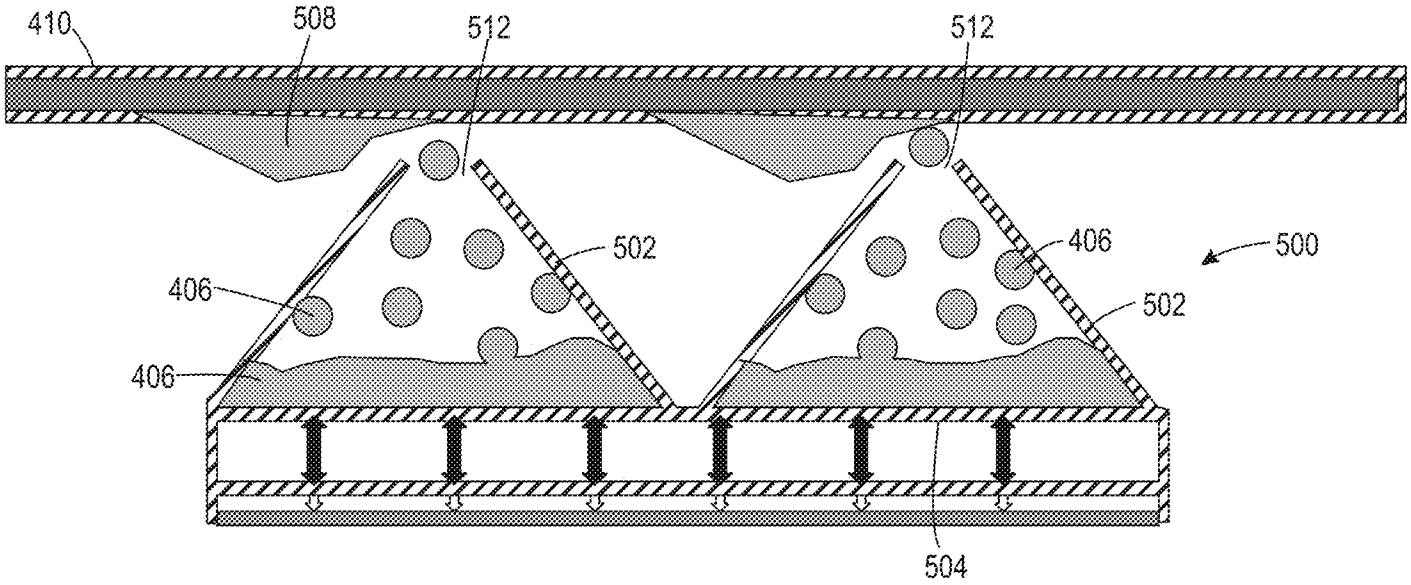

In FIG. 5, a cross-sectional view shows a particle applicator 500 according to another example embodiment. This example shows two particle reservoirs 502 each with a moveable surface 504 that is electrically driven to vibrate. The vibrations cause particles 506 be driven through dispersal ports 512 towards a surface of a print media 510 where a nearby inkjet has deposited a high-resolution pattern of liquid 508. The particle reservoirs 502 include relatively small dispersal ports 512, e.g., approximately the minimum feature size of the deposited liquid 508 (e.g., within ±10% of the minimum feature size), although the ports 512 can be smaller or larger in some embodiments. Note that the surfaces 504 can be driven separately/independently or together.

Figure 6:
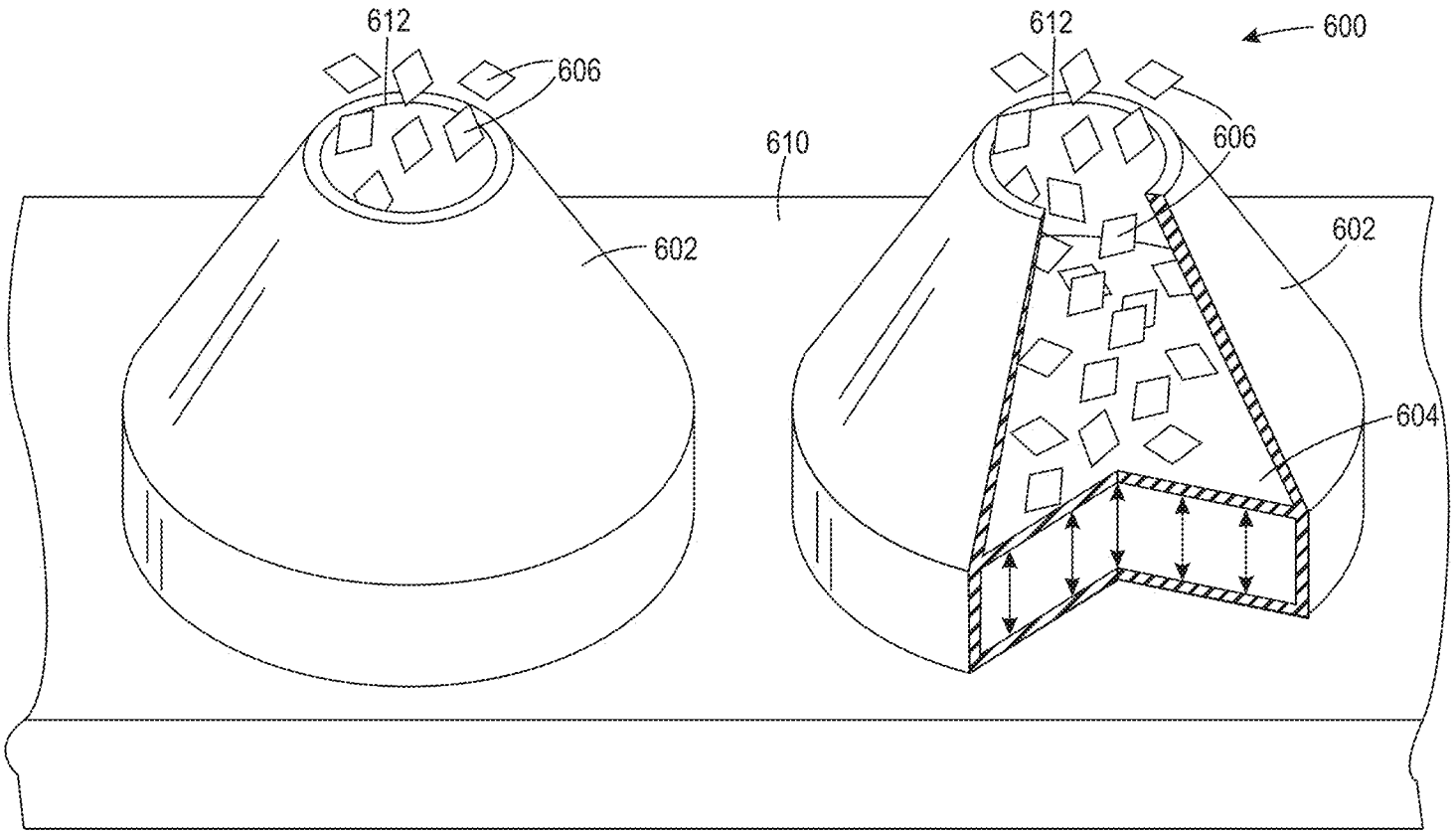
FIGS. 6 and 7 are perspective views of particle applicators according to example embodiments.

An arrangement as shown in FIG. 5 can be configured for point source or line source printing. A perspective cutaway view of a particle applicator 600 in FIG. 6 illustrates a point source configuration according to an example embodiment. The applicator 600 is shown with two particle reservoirs 602 each having a moveable surface 604 (see cutaway view on the right side of the figure) that is electrically driven to vibrate. The vibrations cause particles 606 be driven through a dispersal ports 612 towards a print media (not shown). The particle reservoirs 602 include a relatively small circular dispersal ports 612, e.g., approximately the minimum feature size of the deposited liquid. Also seen in this view is a substrate 610 on which the reservoirs 602 are mounted. The substrate 610 may include electrical lines that power the drive actuators (not shown) that move the surfaces 604. The substrate 610 may also include channels or other features (e.g., augers) of a particle delivery system that replenishes the particles in the reservoirs 602.

Figure 7:
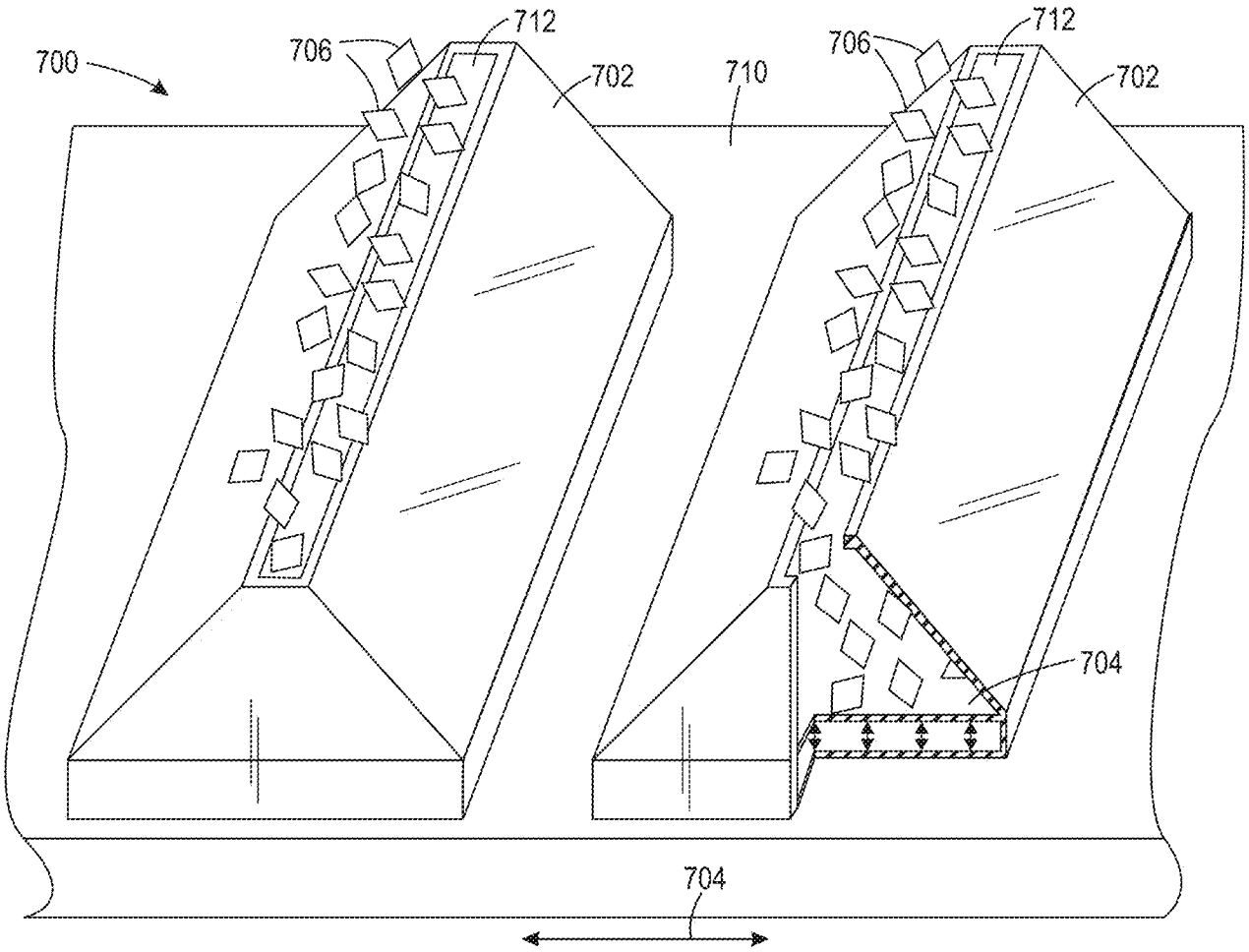

In FIG. 7, perspective cutaway shows a line source configuration of a particle applicator 700 according to an example embodiment. The applicator 700 is shown with two particle reservoirs 702 each with a moveable surface 704 (see cutaway view on the right side of the figure) that is electrically driven to vibrate. The vibrations cause particles 706 to be driven through a dispersal ports 712 towards a print media (not shown). The particle reservoirs 702 include dispersal ports 712 that are relatively small in a print direction 708 but elongated normal to the print direction 708. Also seen in this view is a substrate 710 on which the reservoirs 702 are mounted. The substrate 710 may include features to supply electrical signals and particles to the reservoirs 702.

Figure 8:
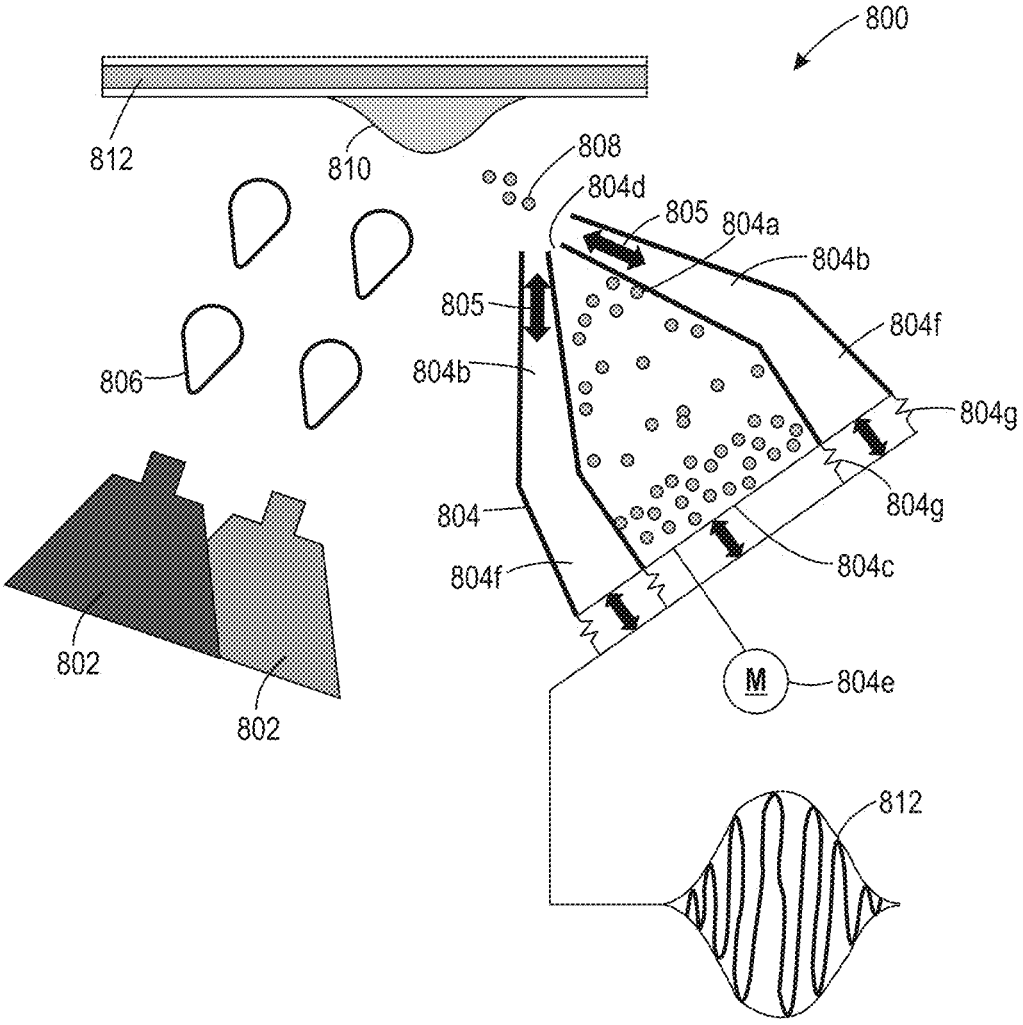
FIG. 8 is a diagram of a printing system according to another example embodiment.

In FIG. 8, a diagram shows an implementation of a printing system 800 according to an example embodiment. Jets 802 are shown that apply fluid 806 to a region 810 of an application surface 812. In this case, two jets 802 are shown, but any number may be used. A particle applicator 804 includes a reservoir **804*a* that has at least one movable surface 804*c*. An electrically-controlled actuator 804*e* causes vibrations of the movable surface 804*c* in response to an input signal 812. Particles 808 exit the particle reservoir 804*a* via a dispersal port 804*d***.

In this embodiment, the particle applicator 804 includes an air jet that influences the particles 808 exiting the dispersal port **804*d*. In this example, the air jet includes an airflow path 804*b* having an exit proximate to the dispersal port 804*d*. The airflow path 804*b* may generally have a shape that corresponds to that of the dispersal port 804*d*. For example, if the dispersal port 804*d* is circular (see, e.g., FIG. 6), the airflow path 804*b* may be annular. If the dispersal port 804*d* is an elongated channel (see, e.g., FIG. 7), the airflow path 804*b*** may also be one or more elongated channels.

A compressible chamber is **804*f* is coupled to the airflow path 804*b* and is configured to force air 805 from the exit of the airflow path 804*b* while the particles 808 are caused to move through the dispersal port 804***d*. The air 805 may increase a velocity of the particles 808 exiting the dispersal port 804*d* and/or affect a flow shape of the particles 808 exiting the dispersal port 804*d*.

In this example the movable surface 804*c* covers both the dispersal port 804*a* and the compressible chamber 804*f* such that inputs from the actuator 804*e* drive both the particles 808 and air 805. One or more flexible surfaces 804*g* (e.g., bellows) prevent air leakage from at least the compressible chamber 804*f*. In other embodiments, separate moving surfaces and/or separate actuators may separately drive the air 805 and particles 808. For example, a single actuator may be mechanically coupled to two separate surfaces that are driven by the actuator but possibly at different stroke distances. In another example, two or more actuators may drive a single surface (e.g., a flexible membrane that spans the chamber 804*f* and reservoir 804*a*) or more than one surface. In this example, the two or more actuators may drive at any combinations of different frequencies and strokes/amplitudes.

Figure 9:
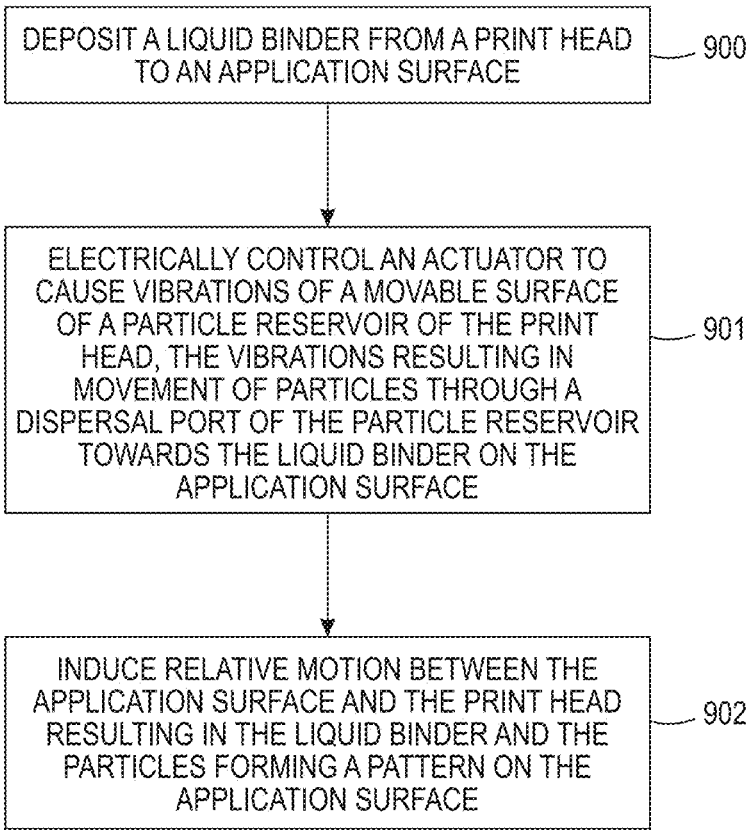
FIG. 9 is a flowchart of a method according to an example embodiment.

In FIG. 9, a flowchart shows a method according to an example embodiment. The method involves depositing 900 a liquid binder from a print head to an application surface, e.g., a print media, a 3-D build surface, a previously deposited layer of a 3-D printed part. An actuator (e.g., linear voice coil motor, piezoactuator) is electrically controlled to cause vibrations of a movable surface of a particle reservoir of the print head. The vibrations result in movement of particles through a dispersal port of the particle reservoir towards the liquid binder on the application surface. Relative motion between the application surface and the print head is induced 902. The relative motion results in the liquid binder and the particles forming a pattern on the application surface.

In FIG. 10, a block diagram illustrates a system according to an example embodiment. The system includes a controller section 1002 that drives one or more print heads 1020. The print head 1020 includes one or more jets 1022 that apply a liquid binder to an application surface 1030. The print head 1020 includes one or more particle applicators 1024. One or more electrically-controlled actuators 1021 cause vibrations of movable surfaces of the particle applicators 1024, which causes particles to exit the particle applicators 1024 and impact the application surface 1030.

The controller section 1002 is coupled to the print head 1020 using a first signal 1032 to cause the jets 1022 to disperse the liquid binder to the surface 1030 in coordination with the particle applicators 1024. The inputs results in movement of the particles from the particle applicators 1024 through their dispersal ports towards the liquid binder on the application surface 1030. The type of signals 1032, 1034 (e.g., pure tones, random noise, combinations thereof, etc.) as well as other aspects of the signals 1032, 1034 such as phase, timing, amplitude, wave shape, etc., can be controlled via software 1010, as indicated by material dispersal module 1012.

One or both of the print head 1020 and application surface 1030 may be driven by linear actuators 1026, 1028 (e.g., motors driving a rack and pinion, belt, etc.) that cause relative motion therebetween in a longitudinal direction 1033. For example, in a conventional printing application, the linear actuator 1026 may control y-displacement of the application surface 1030 and the linear actuator 1028 may control x-displacement of the print head 1020. Each linear actuator 1026, 1028 may include multiple motors or mechanical coupling that allows the print head 1020 and/or application surface 1030 to move in more than one direction. For example, for a 3-D printer application, the linear actuator 1026 may control x- and y-displacement of the application surface 1030 and the linear actuator 1028 may control z-displacement of the print head 1020.

A pattern control module 1014 is a software component that may control this motion, e.g., by receiving a two-dimensional or three-dimensional geometry file and translating the geometry into motor input signals 1036. One or both of the actuators 1026, 1028 may also affect a separation distance 1034 between the print head 1020 and the application surface 1030. This distance 1034 may be set once per print (e.g., printing to a print medium) or dynamically during the print (e.g., 3-D printing, where the distance of the print head 1020 to the build surface is changed for each pass).

The controller section 1002 may include one or more circuit board with special-purpose or general-purpose components. An example of the components includes a central processing unit 1004, memory 1006 (which may include any combination of volatile and non-volatile memory), and input/output circuits 1008. The controller section 1002 and print head 1020 may be integrated into a common chassis as a standalone printer apparatus. In other embodiments, the controller section 1002 and print head 1020 may be physically separated, e.g., in a factory environment where a controller section 1002 may control multiple print heads 1020, application surfaces 1030, and associated control elements.

The system shown in FIG. 10 may be used in a number of applications. As described above, the particle-assisted printing may be used for 2-D printing onto a print media, e.g., for creating printed images, and 3-D printing. Other applications may include patterning of catalysts in flow chemistry, print-on makeup or tattoos, printing/sintering of glass or metals, application of decorations to food, etc. In some applications, such as printable makeup or tattoos, there may be no need for actuators 1026, 1028, as a user would provide the relative motions between the print head 1020 and the applications surface 1030.

The various embodiments described above may be implemented using circuitry, firmware, and/or software modules that interact to provide particular results. One of skill in the arts can readily implement such described functionality, either at a modular level or as a whole, using knowledge generally known in the art. For example, the flowcharts and control diagrams illustrated herein may be used to create computer-readable instructions/code for execution by a processor. Such instructions may be stored on a non-transitory computer-readable medium and transferred to the processor for execution as is known in the art. The structures and procedures shown above are only a representative example of embodiments that can be used to provide the functions described hereinabove.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein. The use of numerical ranges by endpoints includes all numbers within that range (e.g. 1 to 5 includes 1, 1.5, 2, 2.75, 3, 3.80, 4, and 5) and any range within that range.

The foregoing description of the example embodiments has been presented for the purposes of illustration and description. It is not intended to be exhaustive or to limit the embodiments to the precise form disclosed. Many modifications and variations are possible in light of the above teaching. Any or all features of the disclosed embodiments can be applied individually or in any combination are not meant to be limiting, but purely illustrative. It is intended that the scope of the invention be limited not with this detailed description, but rather determined by the claims appended hereto.

The invention claimed is:

1. An apparatus, comprising:

a jet that applies a liquid binder to an application surface;

a particle applicator comprising:

a particle reservoir comprising at least one movable surface;

an electrically-controlled actuator that causes vibrations of the movable surface; and a dispersal port though which solid particles can exit the particle reservoir; and a controller coupled to cause the vibrations via the actuator, the vibrations resulting in levitation of the solid particles through the dispersal port towards the liquid binder on the application surface.

2. The apparatus of claim 1, wherein the application surface and the particle applicator move relative to one another in a longitudinal direction, and wherein the dispersal port is substantially larger than a minimum printable feature size of the applied liquid binder in a lateral direction orthogonal to the longitudinal direction.

3. The apparatus of claim 2, wherein the dispersal port is substantially larger than the minimum printable feature size in the longitudinal direction.

4. The apparatus of claim 1, wherein an area of the dispersal port is approximately a same size as a minimum printable feature size of the applied liquid binder.

5. The apparatus of claim 1, wherein the particle applicator further comprises an air jet that influences the solid particles exiting the dispersal port.

6. The apparatus of claim 5, wherein the air jet further comprises:

an airflow path having an exit proximate to the dispersal port;

a compressible chamber coupled to the airflow path, the compressible chamber configured to force air from the exit while the solid particles are caused to move through the dispersal port, the air exiting the exit of the airflow path impacting the solid particles exiting the dispersal port.

7. The apparatus of claim 6, wherein the movable surface causes compression of the air in the compressible chamber.

8. The apparatus of claim 5, wherein the air affects a spatial distribution of the solid particles exiting the dispersal port.

9. The apparatus of claim 1, wherein the movable surface comprises a flexible surface, flexing of the flexible surface in a direction normal to the flexible surface via the actuator causing the vibrations.

10. The apparatus of claim 1, wherein the vibrations of the movable surface are substantially rigid body motions in a direction normal to the movable surface induced by the actuator.

11. The apparatus of claim 1, wherein the application surface comprises a printing medium.

12. The apparatus of claim 1, wherein the application surface comprises a three-dimensional object built at least partially in a previous pass from the liquid binder and the solid particles.

13. The apparatus of claim 12, wherein the solid particles comprise non-equidimensional shapes that strengthen the three-dimensional object.

14. The apparatus of claim 1, wherein the jet and the particle applicator are integrated into a common print head.

15. A method comprising:

depositing a liquid binder from a print head to an application surface;

electrically controlling an actuator to cause vibrations of a movable surface of a particle reservoir of the print head, the vibrations resulting in levitation of solid particles through a dispersal port of the particle reservoir towards the liquid binder on the application surface; and causing relative motion between the application surface and the print head, the relative motion resulting in the liquid binder and the solid particles forming a pattern on the application surface.

16. The method of claim 15, further comprising compressing air through an airflow path having an exit proximate to the dispersal port while the solid particles are caused to move through the dispersal port, the compressed air impacting the solid particles exiting the dispersal port.

17. The method of claim 15, wherein the application surface comprises a three-dimensional object built at least partially in a previous pass from the liquid binder and the solid particles, and wherein causing the relative motion further comprises dynamically changing a separation distance between the print head and the application surface for each pass.

18. A system comprising:

an application surface;

a print head, comprising:

a jet that applies a liquid binder to the application surface;

a particle applicator comprising:

a particle reservoir comprising at least one movable surface;

an electrically-controlled actuator that causes vibrations of the movable surface; and a dispersal port though which solid particles can exit the particle reservoir; and a controller coupled to the jet to apply the liquid binder and to the actuator of the print head to cause the solid particles to levitate through the dispersal port towards the liquid binder on the application surface; and one or more linear actuators coupled to cause relative motion in a longitudinal direction between the application surface and the print head.

19. The system of claim 18, wherein the particle applicator further comprises:

an airflow path having an exit proximate to the dispersal port; and a compressible chamber coupled to the airflow path, the compressible chamber configured to force air from the exit while the solid particles are caused to move through the dispersal port, the air impacting the solid particles exiting the dispersal port.

20. The system of claim 18, wherein the application surface comprises a three-dimensional object built at least partially in a previous pass from the liquid binder and the solid particles, and wherein the one or more linear actuators dynamically change a separation distance between the print head and the application surface for each pass.

21. The system of claim 18, wherein the dispersal port is substantially larger than a minimum printable feature size in the longitudinal direction.

22. The system of claim 18, wherein an area of the dispersal port is approximately a same size as a minimum printable feature size of the applied liquid binder.

* * * * *